US008322819B2

(12) United States Patent
Umeda

(10) Patent No.: US 8,322,819 B2
(45) Date of Patent: Dec. 4, 2012

(54) LIQUID EJECTOR COMPRISING DETACHABLE DISCHARGE TANK

(75) Inventor: Takaichiro Umeda, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 728 days.

(21) Appl. No.: 12/326,089

(22) Filed: Dec. 1, 2008

(65) Prior Publication Data

US 2009/0141075 A1 Jun. 4, 2009

(30) Foreign Application Priority Data

Nov. 29, 2007 (JP) ..... 2007-308203

(51) Int. Cl.
*B41J 2/165* (2006.01)

(52) U.S. Cl. ..... 347/36; 347/30

(58) Field of Classification Search ..... 347/36, 347/30

See application file for complete search history.

(56) References Cited

U.S. PATENT DOCUMENTS

| | | | | |
|---|---|---|---|---|
| 5,113,206 | A | 5/1992 | Fukazawa | |
| 2005/0195225 | A1 | 9/2005 | Takagi et al. | |
| 2006/0132554 | A1 | 6/2006 | Ota et al. | |
| 2006/0268051 | A1 | 11/2006 | Umeda et al. | |
| 2009/0015632 | A1 * | 1/2009 | Suzuki et al. | 347/36 |
| 2010/0103217 | A1 * | 4/2010 | Takase | 347/30 |

FOREIGN PATENT DOCUMENTS

| | | | | |
|---|---|---|---|---|
| JP | H02-000526 | A | | 1/1990 |
| JP | H02-011334 | A | | 1/1990 |
| JP | H02-016057 | A | | 1/1990 |
| JP | 07025020 | A | * | 1/1995 |
| JP | 07304190 | A | * | 11/1995 |
| JP | H08-267781 | A | | 10/1996 |
| JP | H11-268303 | A | | 10/1999 |
| JP | 2001-310487 | A | | 11/2001 |
| JP | 2001310487 | A | * | 11/2001 |
| JP | 2004-291357 | A | | 10/2004 |
| JP | 2005-254734 | A | | 9/2005 |

(Continued)

OTHER PUBLICATIONS

Machine generated English translation of JP patent document 07-025020 to Nanba et al.,"Ink Jet Recorder" obtained via http://www19.ipdl.inpit.go.jp/PA1/cgi-bin/PA1INDEX on Feb. 27, 2012; 3 pp.*

(Continued)

*Primary Examiner* — Shelby Fidler
(74) *Attorney, Agent, or Firm* — Baker Botts L.L.P.

(57) ABSTRACT

A liquid ejector includes a liquid ejection head, a discharge path, a cap, a pump, a first tank, a second tank, a first valve, and a second valve. The liquid ejection head ejects liquid through a nozzle. The cap covers the nozzle. The pump sucks the liquid from the liquid ejection head through the cap and the nozzle and conveys the liquid to a downstream end of the discharge path. The first tank communicates with the outside air, and temporarily stores the liquid in the discharge path. The second tank is detachably attached to the liquid ejector and is connected to the downstream end of the discharge path. The first valve switches the state of the first tank between open to and cut off from the outside air. The second valve switches the state of the first tank between connection to and cut off from the second tank.

9 Claims, 9 Drawing Sheets

FOREIGN PATENT DOCUMENTS

| | | | | |
|---|---|---|---|---|
| JP | 2006-281508 | A | | 10/2006 |
| JP | 2006281508 | A | * | 10/2006 |
| JP | 2006-326855 | A | | 12/2006 |
| JP | 2006-327030 | A | | 12/2006 |
| JP | 2007-008156 | A | | 1/2007 |
| JP | 2007-030342 | A | | 2/2007 |
| JP | 2007-237664 | A | | 9/2007 |
| JP | 2009061756 | A | * | 3/2009 |
| JP | 2009143161 | A | * | 7/2009 |

OTHER PUBLICATIONS

Machine generated English translation of JP patent document 2006-281508 to Ogawa et al. "Inkjet Recording Apparatus" obtained via http://www19.ipdl.inpit.go.jp/PA1/cgi-bin/PA1INDEX on Feb. 24, 2012; 9 pp.*

Japan Patent Office, Notice of Reasons for Rejection for Japanese Patent Application No. 2007-308203 (counterpart to above-captioned patent application), mailed Dec. 6, 2011.

* cited by examiner

LIQUID EJECTOR COMPRISING DETACHABLE DISCHARGE TANK

CROSS REFERENCE TO RELATED APPLICATION

The present application claims priority from Japanese Patent Application No. 2007-308203, which was filed on Nov. 29, 2007, the disclosure of which is herein incorporated by reference in its entirety.

BACKGROUND OF THE INVENTION

1. Field of the Invention

The present invention relates to a liquid ejector which ejects a liquid from a nozzle.

2. Description of Related Art

Japanese Unexamined Patent Publication No. 2007-8156 recites an inkjet recording apparatus in which a suction pump connected to a suction cap is driven while a nozzle of the inkjet head is sealed with the suction cap, with the result that suction purge by which ink is sucked through the nozzle is performed and the sucked ink is absorbed by an waste-liquid foam.

SUMMARY OF THE INVENTION

This inkjet recording apparatus recited in Japanese Unexamined Patent Publication No. 2007-8156, however, is disadvantageous in that suction purge cannot be performed any more when the waste-liquid foam is saturated with the absorbed ink because of repeated suction purge. Consequently the inkjet recording apparatus becomes unavailable even if components other than the waste-liquid foam, such as an inkjet head, are still usable. This results in shortened life of the inkjet recording apparatus.

An object of the present invention is to provide a liquid ejector with long life.

According to the first aspect of the present invention there is provided a liquid ejector including a liquid ejection head, a discharge path, a cap, a pump, a first tank, a second tank, a first valve, a second valve, and a control unit. The liquid ejection head ejects a liquid through a nozzle. The discharge path is used for discharging the liquid from the liquid ejection head. The cap is connected to an upstream end of the discharge path and covers the nozzle. The pump is provided in the middle of the discharge path. The pump sucks the liquid from the liquid ejection head through the cap and the nozzle and conveys the liquid from the upstream end to a downstream end of the discharge path. The first tank is provided downstream of the pump on the discharge path, communicates with the outside air, and temporarily stores the liquid in the discharge path. The second tank is detachably attached to the liquid ejector and is connected to the downstream end of the discharge path when the second tank is attached to the liquid ejector. The first valve switches the state of the first tank between open to the outside air and cut off from the outside air. The second valve switches the state of the first tank between connection to and cut off from the second tank. The control unit controls the pump, the first valve, and the second valve.

In the first aspect of the present invention, the pump is driven while the first valve does not cut off the first tank from the outside air whereas the second valve cuts off the first tank from the second tank. With this, via the cap, the liquid in the liquid ejection head is sucked through the nozzle and conveyed to the first tank. In the meanwhile, the pump is driven while the first valve cuts off the first tank from the outside air whereas the second valve does not cut off the first tank from the second tank. With this, the liquid stored in the first tank is conveyed to the second tank. The amount of the liquid in the first tank is reduced as a result, and hence a space for storing liquid is created in the first tank. It therefore becomes possible to continue the operation of sucking a liquid from the liquid ejection head and conveying the liquid to the first tank through the discharge path. This elongates the life of the liquid ejector.

Furthermore, as discussed above, the pump can function as not only a power source for sucking the liquid in the liquid ejection head through the nozzle and conveying the liquid to the first tank but also for conveying the liquid from the first tank to the second tank, because of the switching by the first valve and the second valve. Therefore it is unnecessary to provide different power sources and hence the structure of the liquid ejector is kept simple.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

The following describes a preferred embodiment of the present invention.

Figure 1:
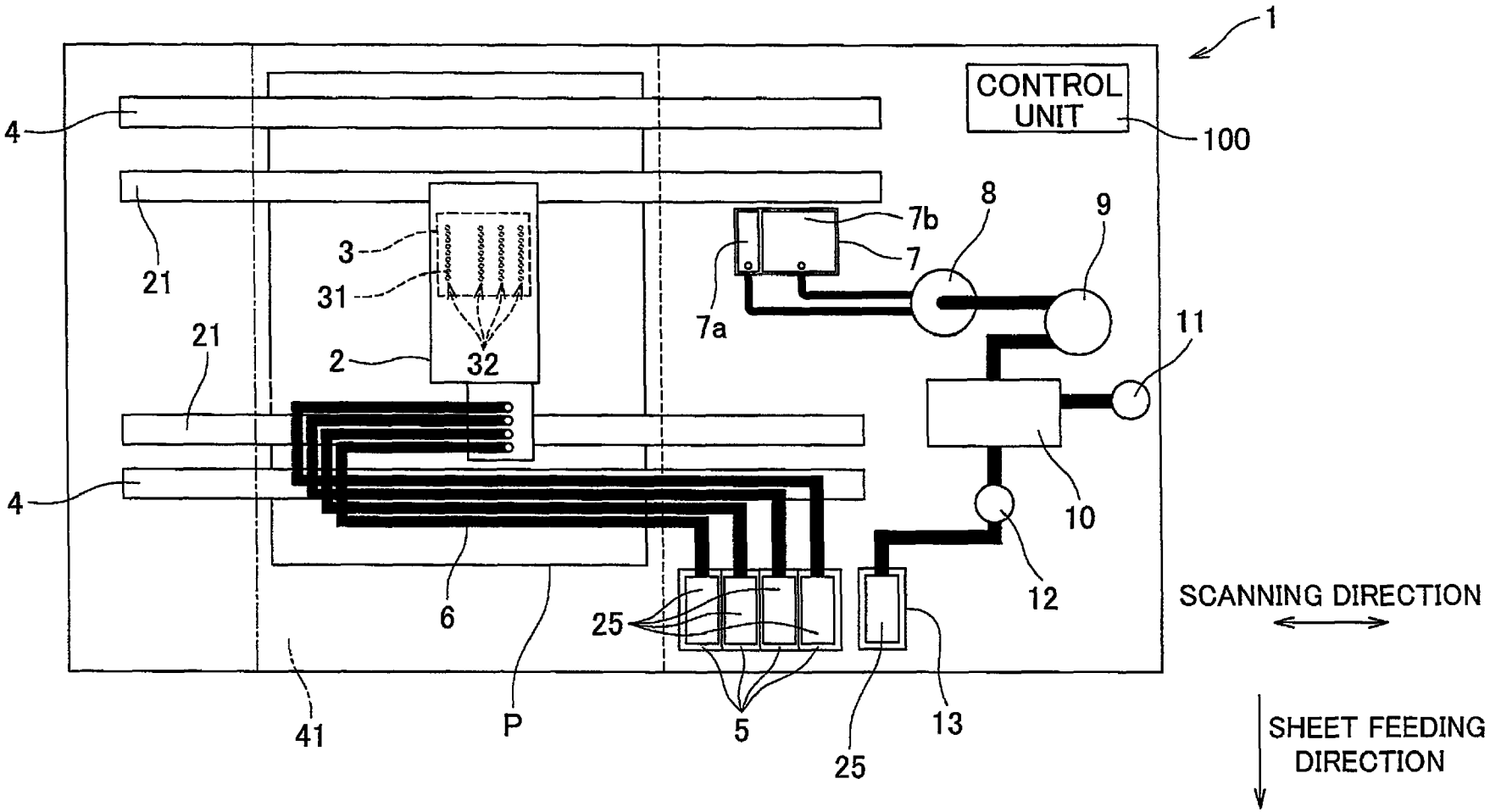
FIG. 1 is a schematic diagram of a printer of an embodiment of the present invention.
Figure 2:
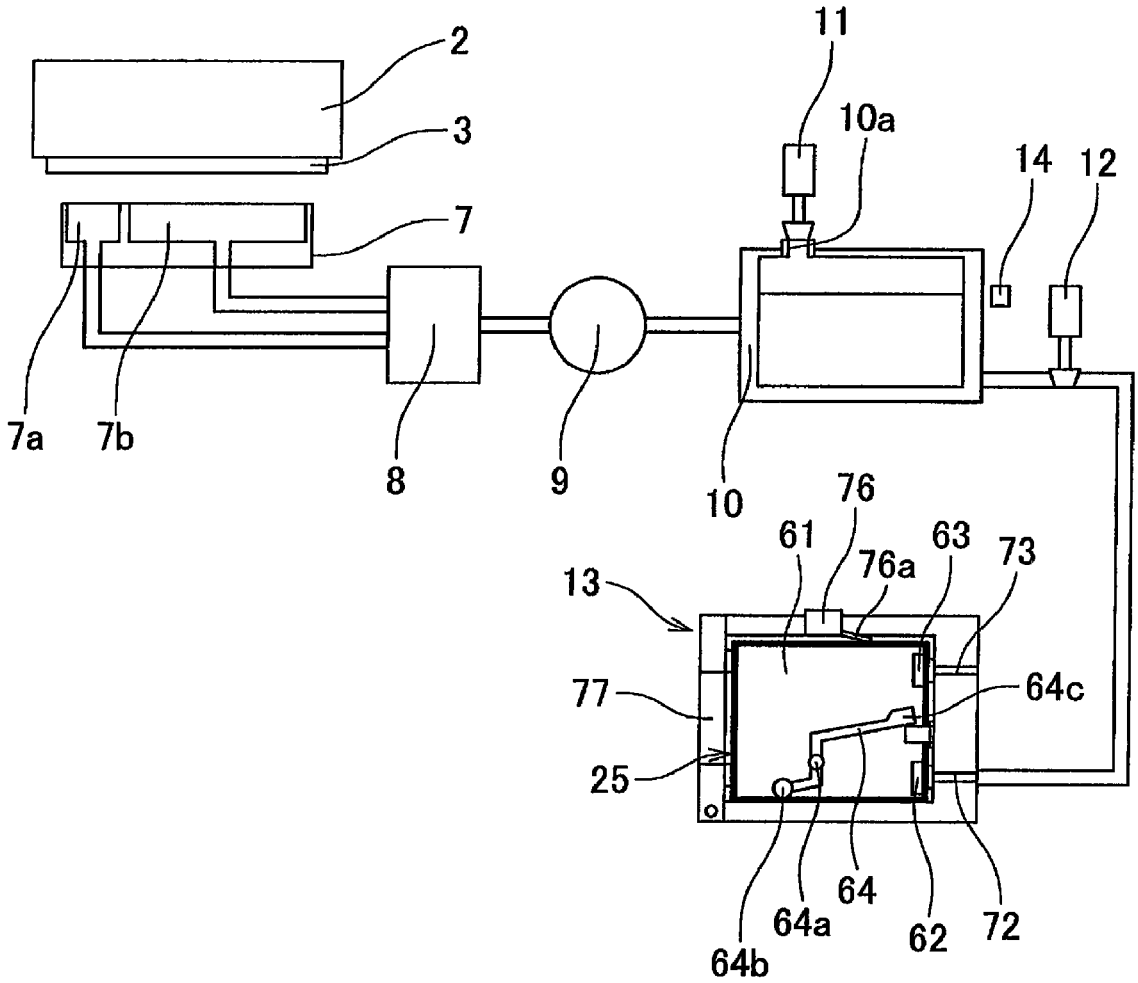
FIG. 2 shows the ink discharge path of FIG. 1.

FIG. 1 is a schematic diagram of a printer of the present invention. FIG. 2 illustrates an ink discharge path which has the upstream end connected to a later-detailed suction cap 7 of FIG. 1 and the downstream end connected to a second cartridge attaching unit 13. As shown in FIGS. 1 and 2, the printer 1 includes components such as a carriage 2, an inkjet head 3, a sheet feeding roller 4, a first cartridge attaching unit 5, tubes 6, a suction cap 7, a switching unit 8, a pump 9, a storage tank 10, and the second cartridge attaching unit 13. The operation of the printer 1 is controlled by the control unit 100.

The carriage 2 is driven by an unillustrated driver so as to reciprocate along the scanning directions in parallel to the crosswise direction in FIG. 1, i.e. reciprocate in the scanning directions along two guides 21 extending perpendicular to a predetermined direction of the present invention. These two guides 21 extend, in both scanning directions, beyond the boundaries of a sheet conveyance path 41 on which later-described record sheets P are carried. This allows the carriage 2 to reciprocate in the scanning directions beyond the boundaries of the sheet conveyance path 41.

The inkjet head 3 is disposed on the lower surface of the carriage 2. The inkjet head 3 has plural nozzles 31 on its lower surface, and ejects ink from the nozzles 31 by pressurizing, by using an unillustrated piezoelectric actuator, ink in an unillustrated pressure chamber which communicates with the nozzles 31. The nozzles 31 are aligned along a sheet feeding direction in parallel to the vertical directions in FIG. 1, so as to constitute nozzle strings 32. Four nozzle strings 32 are aligned in parallel to the scanning directions. From the leftmost string to the rightmost string in FIG. 1, these four nozzle strings 32 respectively eject black, yellow, cyan, and magenta inks from the nozzles 31 constituting each of them.

Along the sheet conveyance path 41, the sheet feeding roller 4, which is a liquid target medium carrier unit, carries a record sheet P which is a liquid target medium in a sheet feeding direction toward the bottom of FIG. 1, i.e. in a predetermined direction. In the printer 1, ink is ejected from the nozzles 31 of the inkjet head 3 reciprocating in the scanning directions along with the carriage 2 to a record sheet P carried in the sheet feeding direction by the sheet feeding roller 4, so that the ink lands on the record sheet P. In this way printing is done on the record sheet P.

The first cartridge attaching unit 5 is disposed to be adjacent to the lower right end of the sheet conveyance path 41 in FIG. 1. To the first cartridge attaching unit 5, it is possible to attach ink cartridges 25 filled respectively with black, yellow, cyan, and magenta inks. The ink cartridge 25 attached to the first cartridge attaching unit 5 is equivalent to a third tank of the present invention. The third tank is attachable/detachable to/from the printer 1 (apparatus).

Figure 3A:
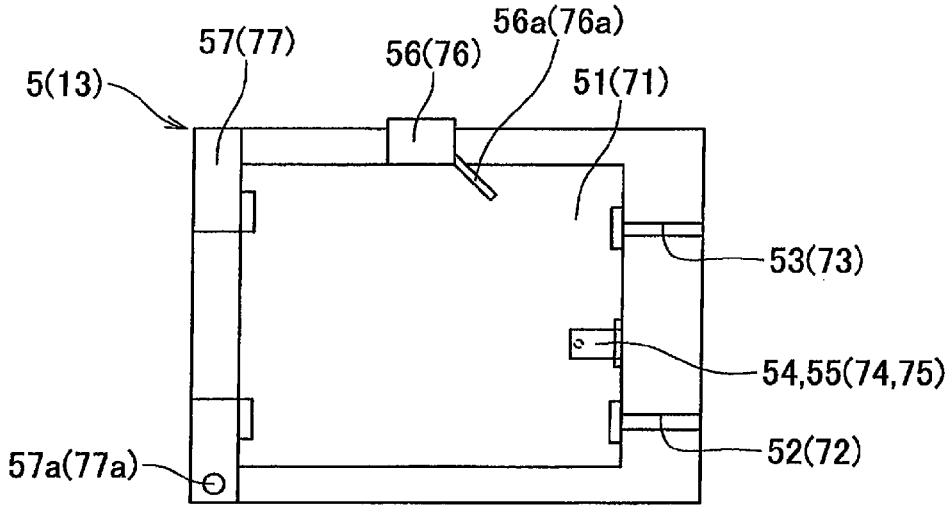
FIG. 3A is a profile of the first or second cartridge attaching unit of FIG. 1, when an ink cartridge is not attached.
Figure 3B:
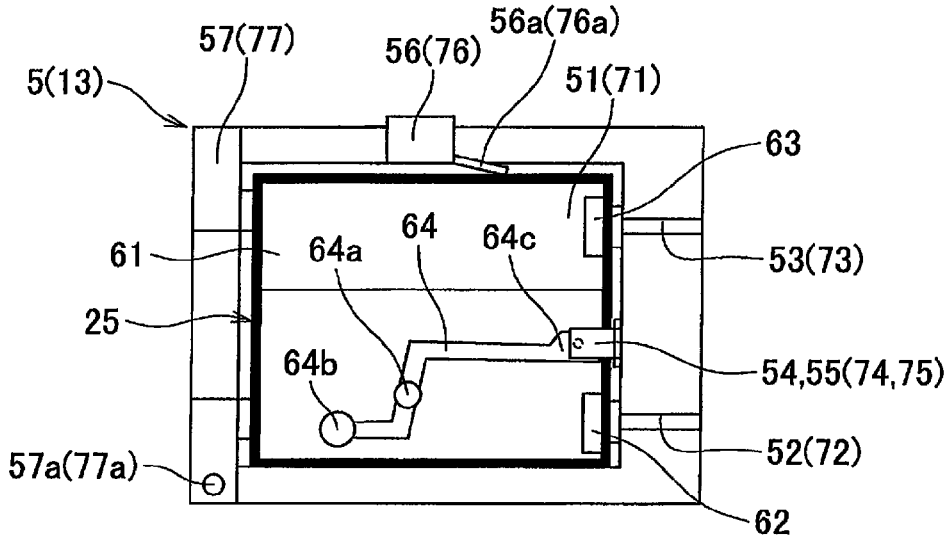
FIG. 3B is a profile of the first or second cartridge attaching unit of FIG. 1, when an ink cartridge in which a predetermined amount or more of ink remains is attached.
Figure 3C:
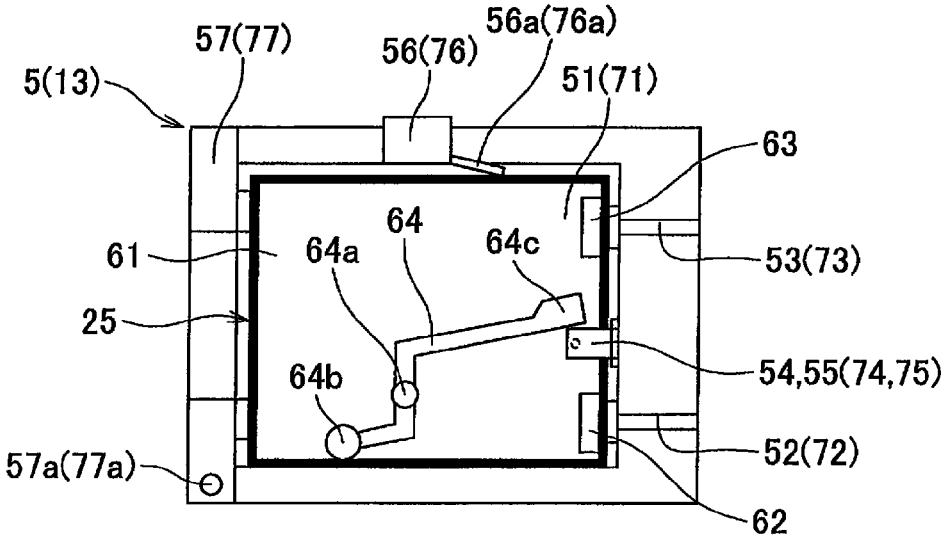
FIG. 3C is a profile of the first or second cartridge attaching unit of FIG. 1, when an ink cartridge in which the amount of remaining ink is smaller than the predetermined amount is attached.

Now, the first cartridge attaching unit 5 and the ink cartridges 25 attached to the first cartridge attaching unit 5 are detailed. FIG. 3A is a profile of the first cartridge attaching unit 5, when no ink cartridge 25 is attached. FIG. 3B is a profile of the first cartridge attaching unit 5, when an ink cartridge 25 in which a predetermined amount or more of ink remains is attached. FIG. 3C is a profile of the first cartridge attaching unit 5, when an ink cartridge 25 in which the amount of remaining ink is lower than the predetermined amount is attached.

As illustrated in FIGS. 3A to 3C, the first cartridge attaching unit 5 has a cartridge storage space 51, an ink flow path 52, an air hole 53, a light emitting unit 54, a light receiving unit 55, an attaching sensor 56, and a lid 57. The cartridge storage space 51 is a space which is open to the left side in FIGS. 3A to 3C. An ink cartridge 25 is inserted into the cartridge storage space 51 through the opening on the left side of FIGS. 3A to 3C.

The ink flow path 52 extends to the right in FIGS. 3A to 3C from the vicinity of the lower end of the right wall of the cartridge storage space 51 in FIGS. 3A to 3C. The right end of the ink flow path 52 is connected to the inkjet head 3 via the tube 6. The air hole 53 extends to the right in FIGS. 3A to 3C from the vicinity of the upper end of the right wall of the cartridge storage space 51 in FIGS. 3A to 3C. This air hole 53 is open to the outside air.

The light emitting unit 54 and the light receiving unit 55 oppose each other in the direction perpendicular to the surfaces of FIGS. 3A to 3C. The light emitting unit 54 emits laser light towards the light receiving unit 55. The light receiving unit 55 receives laser light from the light emitting unit 54. As discussed later, whether a remaining amount of ink in the ink cartridge 25 attached to the first cartridge attaching unit 5 is smaller than a predetermined remaining amount is detectable based on whether the light receiving unit 55 receives laser light from the light emitting unit 54.

The attaching sensor 56 is disposed in the wall which defines the upper face of the cartridge storage space 51. From the lower end of this sensor 56, the lever 56*a* extends so as to reach the inside of the cartridge storage space 51. As illustrated in FIG. 3B and FIG. 3C, the attaching sensor 56 detects that an ink cartridge 25 is attached to the first cartridge attaching unit 5, when the attaching sensor 56 detects that a lever 56*a* is lifted up because the ink cartridge 25 is attached to the first cartridge attaching unit 5.

The lid 57 is used for closing the opening of the cartridge storage space 51, which is on the left side in FIGS. 3A to 3C. The lid 57 is rotatable about a fulcrum 57*a* which is provided at the lower end thereof. In FIGS. 3A to 3C, the lid 57 covers the aforesaid opening of the cartridge storage space 51. The lid 57 in this state is rotated anticlockwise for about 180° so that the opening of the cartridge storage space 51 is uncovered, and through this opening an ink cartridge 25 is inserted into the cartridge storage space 51. An ink cartridge 25 is attached to the cartridge storage space 51 in this way. As shown in FIG. 3B and FIG. 3C, when the ink cartridge 25 is attached to the cartridge storage space 51 and the lid 57 covers the opening of the cartridge storage space 51, the lid 57 pushes the left-side wall of the ink cartridge 25 in FIGS. 3A to 3C toward the right edge of each figure. This ensures the adhesion between the ink flow path 52 and an ink supplying unit 62 and between the air hole 53 and an outside-air passage unit 63.

The ink cartridge 25 has a substantially cuboid shape and includes an ink storage space 61, the ink supplying unit 62, an outside-air passage unit 63, and a rotating component 64. The ink storage space 61 is filled with ink which is to be supplied to the inkjet head 3. The ink supplying unit 62 is disposed in the vicinity of the lower end of the right-side wall of the ink storage space 61 in FIGS. 3A to 3C. The ink supplying unit 62 is connected to the ink flow path 52 when the ink cartridge 25 is attached to the first cartridge attaching unit 5. The ink supplying unit 62 has an unillustrated valve. This valve is opened only when the ink cartridge 25 is attached to the first cartridge attaching unit 5, and the ink storage space 61 communicates with the ink flow path 52 when the valve is open. When the valve is open, ink in the ink storage space 61 is supplied to the inkjet head 3 through the ink flow path 52 and the tube 6.

The outside-air passage unit 63 is disposed in the vicinity of the upper end of the right-side wall of the ink cartridge 25 in FIGS. 3A to 3C. The outside-air passage unit 63 is connected to the air hole 53 when the ink cartridge 25 is attached to the first cartridge attaching unit 5. The outside-air passage unit 63 has an unillustrated valve which is opened only when the ink cartridge 25 is attached to the first cartridge attaching unit 5. When the ink inside the ink storage space 61 flows out through the ink flow path 52, air is introduced into the ink storage space 61 through the outside-air passage unit 63 as much as the ink flowing out.

The rotating component 64 is provided inside the ink storage space 61. The rotating component 64 is supported at a fulcrum 64*a* so as to be rotatable in clockwise and anticlockwise directions in FIGS. 3A to 3C. At the left hand end of the rotating component 64 in FIGS. 3A to 3C, a float 64*b* is provided. As an amount of ink inside the ink storage space 61 changes (i.e. the height of the liquid level changes), the ink provides buoyancy to the float 64*b* so that the rotating component 64 rotates.

In the meanwhile, at the right hand end of the rotating component in FIGS. 3A to 3C, a light blocking section 64*c* is formed. As illustrated in FIG. 3B, this light blocking section 64*c* is positioned to block laser light emitted from the light emitting unit 54, when an amount of ink in the ink cartridge 25 is not smaller than a predetermined remaining amount. In this state the light receiving unit 55 does not receive laser light. The rotating component 64 rotates as the amount of ink inside the ink cartridge 25 decreases. When the amount of ink inside the ink cartridge 25 becomes smaller than the predetermined remaining amount, the light blocking section 64*c* moves to a position of not blocking laser light emitted from the light emitting unit 54, as illustrated in FIG. 3C. In this state the light receiving unit 55 receives laser light emitted from the light emitting unit 54. It is therefore possible, by detecting whether the light receiving unit 55 receives laser light or not, to detect whether an amount of ink in the ink cartridge 25 attached to the first cartridge attaching unit 5 is smaller than a predetermined remaining amount, i.e. to detect whether the ink cartridge 25 is in the empty state or not.

Back to FIGS. 1 and 2, the tube 6 connects the first cartridge attaching unit 5 with the inkjet head 3. The ink inside the ink cartridge 25 attached to the first cartridge attaching unit 5 is therefore supplied to the inkjet head 3 through the tube 6.

The suction cap 7 is disposed to face the carriage 2 when the carriage 2 is at the rightmost position in FIG. 1, which position is to the right of the sheet conveyance path 41. The suction cap 7 is connected to the upstream end of the ink discharge path. The suction cap 7 includes: a first cap unit 7*a* used to cover the nozzles 31 which constitute the leftmost nozzle string 32 in FIG. 1 and eject black ink; and a second cap unit 7*b* used to cover the nozzles 31 which constitute the second leftmost to the rightmost nozzle strings 32 in FIG. 1 and eject color inks, i.e. yellow, cyan, and magenta inks. In addition to the above, the suction cap 7 is arranged to be movable in the vertical directions in FIG. 2. This makes it possible to cover the corresponding nozzles 31 by the cap units 7*a* and 7*b* by raising the suction cap 7 after the carriage 2 is moved to the position where the inkjet head 3 faces the suction cap 7.

The switching unit 8 is provided in the middle of the ink discharge path, and selectively connects at least one of the first cap unit 7*a* and the second cap unit 7*b* of the suction cap 7 with the pump 9. The pump 9 is disposed downstream of the switching unit 8 which is in the middle of the ink discharge path. The pump 9 is a known pump such as a tube pump. The pump 9 sucks ink from the inkjet head 3 through the nozzles 31, via the at least one of the first cap unit 7*a* and the second cap unit 7*b* with which the pump 9 is connected via the switching unit 8. The pump 9 then conveys the sucked ink toward the storage tank 10, i.e. conveys the ink from the upstream to the downstream of the ink discharge path. Thickened portions of the ink and contaminants in the ink are removed from the inkjet head 3 as a result, and hence clogging of the nozzles 31 is prevented.

The storage tank 10 which is a first tank is disposed downstream of the pump 9 in the ink discharge path. The storage tank 10 is fixed to the printer 1 and not detachable therefrom. The storage tank 10 temporarily stores ink sucked from the inkjet head 3, i.e. ink ejected from the inkjet head 3 to the ink discharge path. The storage tank 10 has a connection hole 10*a* which is open to the outside air. The connection hole 10*a* is provided with a first valve 11. The first valve 11 switches the state of the storage tank 10 between open to the outside air and cutoff from the outside air. Provided in the vicinity of the storage tank 10 is a liquid level sensor 14 which can detect whether the liquid level of the ink in the storage tank 10 is higher than a predetermined height. This makes it possible to detect whether an amount of ink stored in the storage tank 10 is not smaller than a predetermined reference storage amount.

The second cartridge attaching unit 13 is connected to the downstream end of the ink discharge path. To/from this second cartridge attaching unit 13, a used ink cartridge 25 which is in the empty state is attachable/detachable. Therefore an ink cartridge 25 attached to the second cartridge attaching unit 13 is connected to the downstream end of the ink discharge path. Ink in the ink discharge path is, as discussed later, discharged to the ink cartridge 25 attached second cartridge attaching unit 13. In this way, a used ink cartridge 25 is effectively recycled by attaching it to the second cartridge attaching unit 13. It is noted that the ink cartridge 25 attached to the second cartridge attaching unit 13 is equivalent to the second tank of the present invention, and the second tank is attachable/detachable to/from the printer 1. It is also noted that the second tank of the present invention is a used third tank.

Now, details of the second cartridge attaching unit 13 are given. It is noted that the description is given using FIGS. 3A to 3C because the second cartridge attaching unit 13 is substantially identical with the first cartridge attaching unit 5. In FIGS. 3A to 3C, the numbers in parentheses indicate the respective components of the second cartridge attaching unit 13.

The second cartridge attaching unit 13 includes a cartridge storage space 71, an ink flow path 72, an air hole 73, a light emitting unit 74, a light receiving unit 75, an attaching sensor 76, and a lid 77. The cartridge storage space 71 is a space where a used ink cartridge 25 is inserted. This space 71 is arranged to be identical with the cartridge storage space 51. The ink flow path 72 is identical with the ink flow path 52, and the right hand end of the path 72 is connected to the storage tank 10. The ink conveyed from the storage tank 10 to the downstream of the ink discharge path flows through the ink flow path 72 into the ink storage space 61 of the ink cartridge 25 attached to the cartridge storage space 71. The air hole 73 is identical with the air hole 53 in terms of the structure. When the ink flows into the ink storage space 61, air is discharged to the outside from the ink storage space 61 through the outside-air passage unit 63 and the air hole 73 as much as the ink flowing in.

Detailed descriptions of the light emitting unit 74, the light receiving unit 75, the attaching sensor 76, and the lid 77 are not given because they are identical with the air hole 53, the light emitting unit 54, the light receiving unit 55, the attaching sensor 56, and the lid 57, respectively.

Back to FIGS. 1, 2, the second cartridge attaching unit 13 is disposed to the right of the sheet conveyance path 41 in the scanning directions, along with the suction cap 7, the switching unit 8, the pump 9, and the storage tank 10. In other words, with respect to the sheet conveyance path 41, the second cartridge attaching unit 13 is on the same side as the suction cap 7, the switching unit 8, the pump 9, and the storage tank 10. This results in the suction cap 7, the switching unit 8, the pump 9, the storage tank 10, and the second cartridge attaching unit 13 being close to one another, and hence the later-detailed conveyance of ink on the ink discharge path is easily done, including the later-detailed conveyance of ink from the storage tank 10 to the ink cartridge 25 attached to the second cartridge attaching unit 13.

Between the storage tank 10 and the second cartridge attaching unit 13, disposed is a second valve 12. The second valve 12 switches the state of the storage tank 10 between connection to and cutoff from the second cartridge attaching unit 13, more specifically, between connection to and cutoff from the ink cartridge 25 attached to the second cartridge attaching unit 13.

In the printer 1, the pump 9 is driven while the aforesaid first valve 11 does not cut off the storage tank 10 from the outside air whereas the second valve 12 cuts off the storage tank 10 from the second cartridge attaching unit 13. With this, ink in the inkjet head 3 is sucked through the nozzles 31 and conveyed to the storage tank 10 (first conveyance mode).

On the other hand, the pump 9 is driven while the first valve 11 cuts off the storage tank 10 from the outside air whereas the second valve 12 does not cut off the storage tank 10 from the second cartridge attaching unit 13. With this, ink stored in the storage tank 10 is conveyed to the ink cartridge 25 attached to the second cartridge attaching unit 13 (second conveyance mode).

In this way, in the present embodiment the pump 9 functions not only as a power source for sucking ink from the inkjet head 3 through the nozzles 31 and conveying the same to the storage tank 10 but also a power source for conveying ink stored in the storage tank 10 to the second cartridge attaching unit 13, more specifically to the ink cartridge 25 attached to the second cartridge attaching unit 13. Therefore it is unnecessary to provide different power sources and hence the structure of the printer 1 is kept simple. In addition to the above, the aforesaid first and second conveyance modes are easily switchable by (i) switching the state of the storage tank 10 between connection to and cut off from the outside air by the first valve 11 and (ii) switching, by the second valve 12, the state of the storage tank 10 between connection to and cut off from the second cartridge attaching unit 13, more specifically connection to and cut off from the ink cartridge 25 attached to the second cartridge attaching unit 13.

Figure 4:
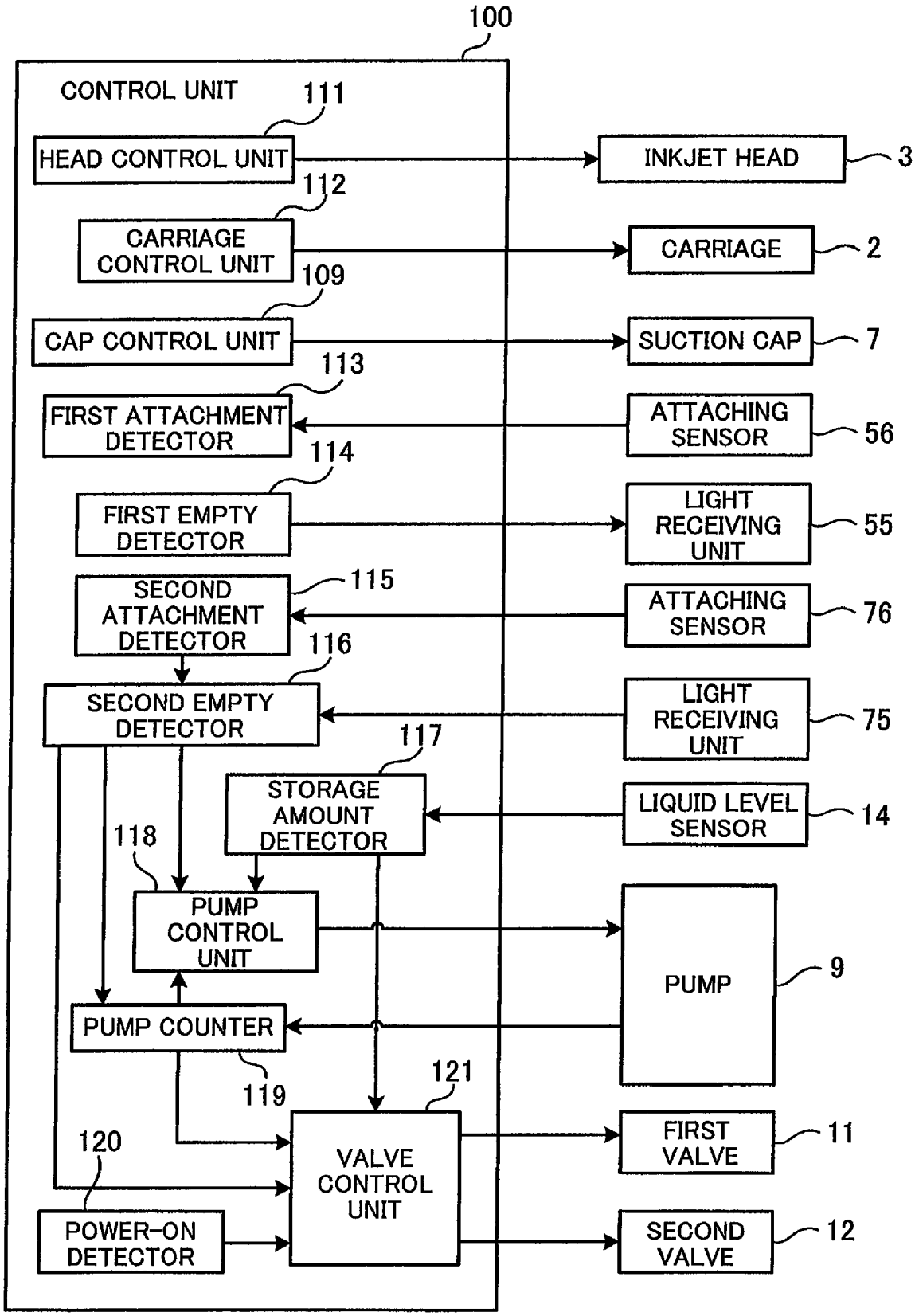
FIG. 4 is a block diagram of the control unit of FIG. 1.

The following describes the control unit 100 which controls the operation of the printer 1. FIG. 4 is a block diagram of the control unit 100 of FIG. 1.

The control unit 100 is constituted by components such as a CPU (Central Processing Unit), a ROM (Read only Memory), and a RAM (Random Access Memory). As shown in FIG. 4, these components function as a head control unit 111, a carriage control unit 112, cap control unit 109, a first attachment detector 113, a first empty detector 114, a second attachment detector 115, a second empty detector 116, a storage amount detector 117, a pump control unit 118, a pump counter 119, a power-on detector 120, and a valve control unit 121.

The head control unit 111 controls the operation of the inkjet head 3 when it ejects ink from the nozzles 31. The carriage control unit 112 controls the movement of the carriage 2. The cap control unit 109 controls the vertical movement of the suction cap 7. The first attachment detector 113 detects whether an ink cartridge 25 is attached to the first cartridge attaching unit 5 by detecting whether the lever 56*a* of the attaching sensor 56 is lifted up by the ink cartridge 25. When the first attachment detector 113 has detected that an ink cartridge 25 is attached to the first cartridge attaching unit 5, the first empty detector 114 detects whether that ink cartridge is in the empty state by detecting whether the light receiving unit 55 receives laser light.

The second attachment detector 115 detects whether an ink cartridge 25 is attached to the second cartridge attaching unit 13 by detecting whether the lever 76*a* of the attaching sensor 76 is lifted up by the ink cartridge 25. When the second attachment detector 115 has detected that an ink cartridge 25 is attached to the second cartridge attaching unit 13, the second empty detector 116 detects whether that ink cartridge 25 is in the empty state by detecting whether the light receiving unit 75 receives laser light.

The storage amount detector 117 detects whether an amount of ink stored in the storage tank 10 is not smaller than a reference storage amount by causing the liquid level sensor 14 to detect whether the liquid level of the ink in the storage tank 10 is at a predetermined height or higher. The pump control unit 118 controls the operation of the pump 9. The pump counter 119 counts how many times the pump 9 is driven. The power-on detector 120 detects whether the printer 1 is powered on. The valve control unit 121 controls the operations of the first valve 11 and the second valve 12.

Figure 5:
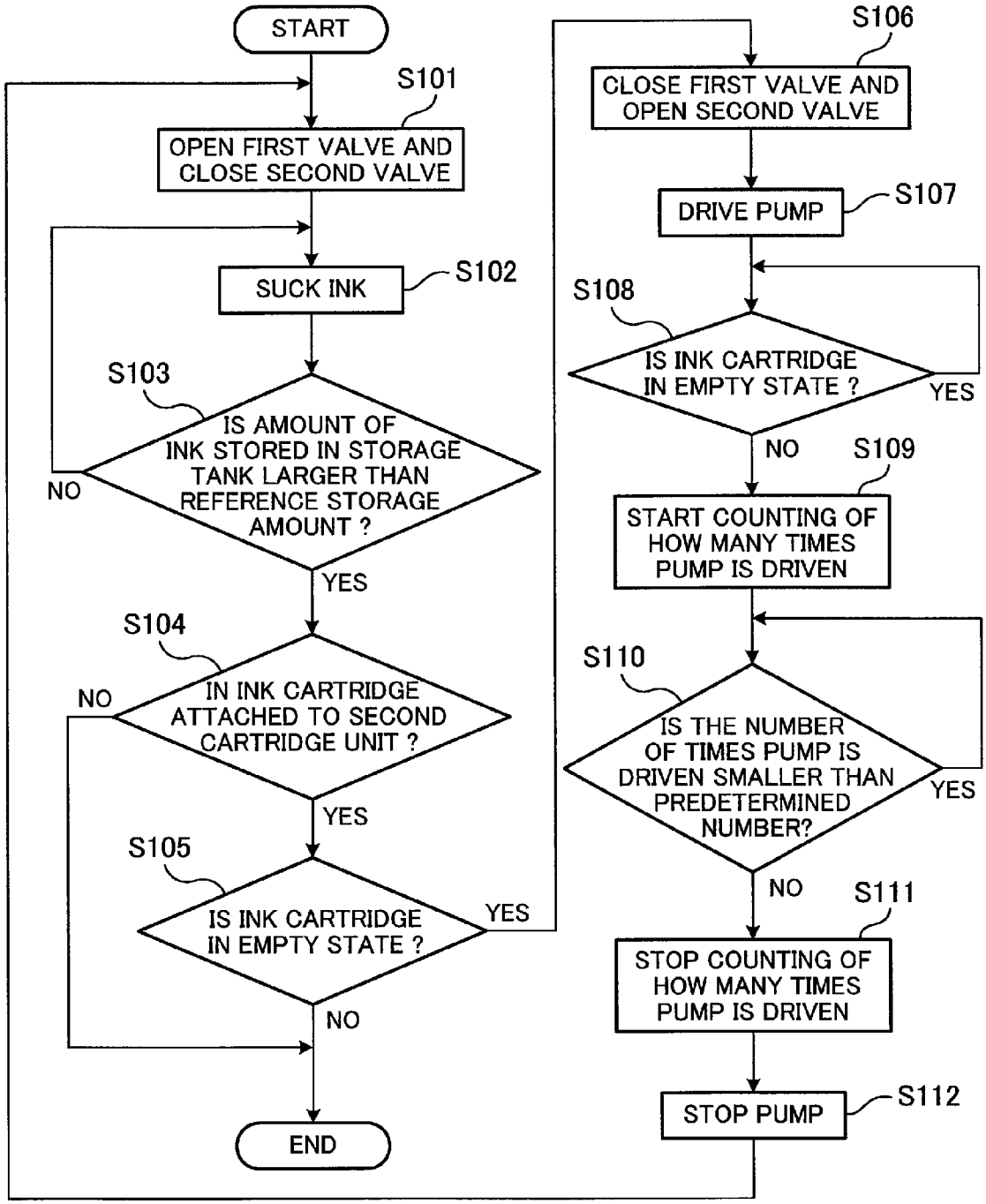
FIG. 5 is a flowchart of a process to suck ink from the inkjet head, convey the ink to the storage tank and further convey the ink to the ink cartridge attached to the second cartridge attaching unit.
Figure 6:
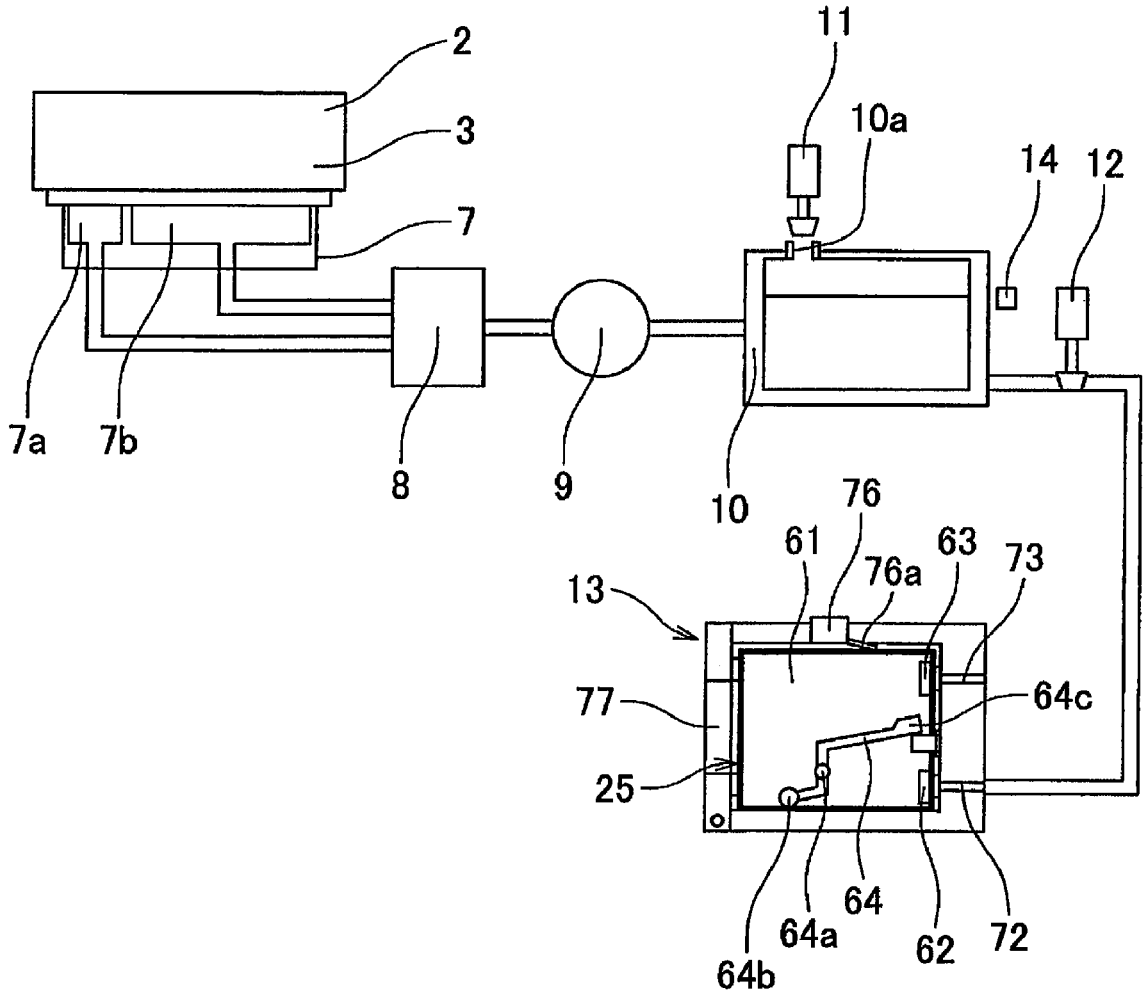
FIG. 6 is equivalent to FIG. 2 and shows a case where ink is sucked from the inkjet head and conveyed to the storage tank.
Figure 7:
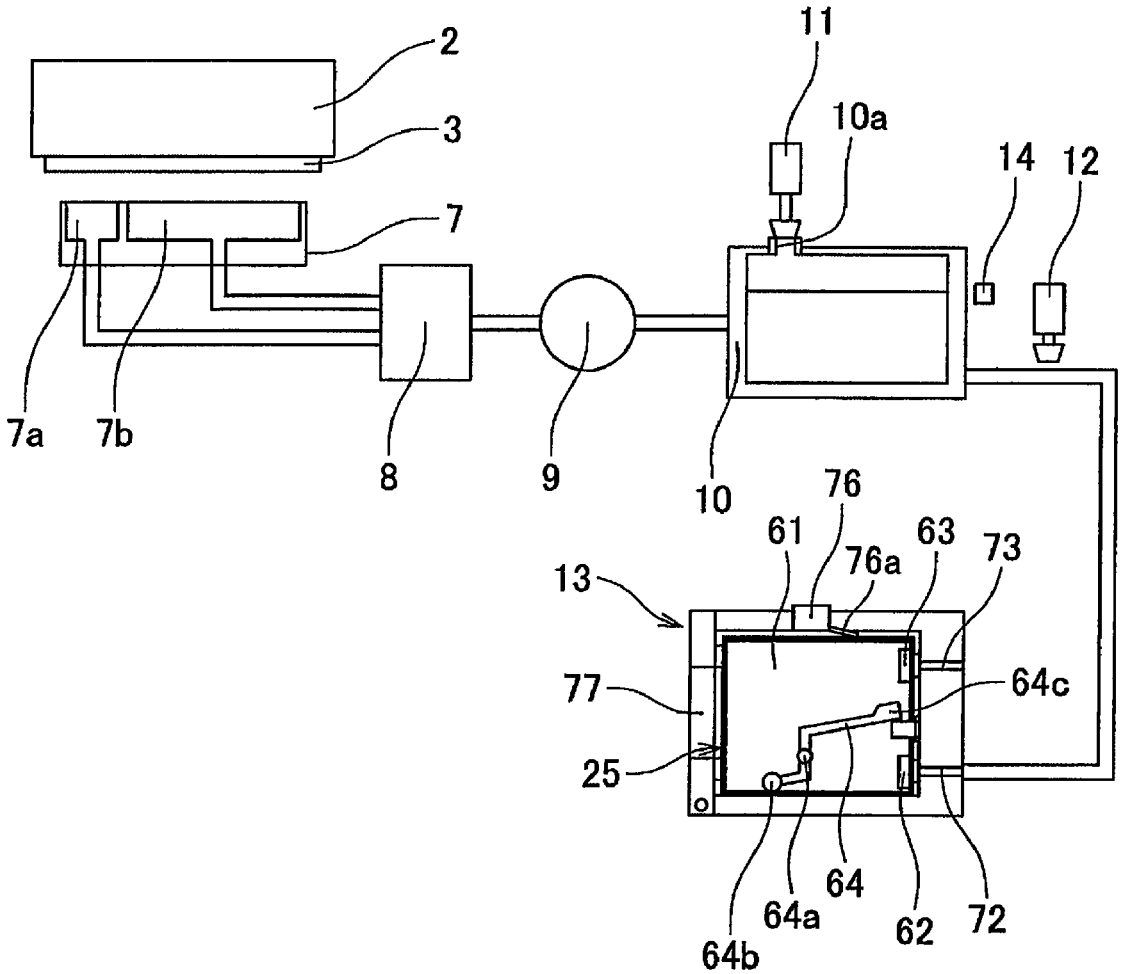
FIG. 7 is equivalent to FIG. 2 and shows a case where ink is conveyed from the storage tank to the ink cartridge attached to the second cartridge attaching unit.
Figure 8A:
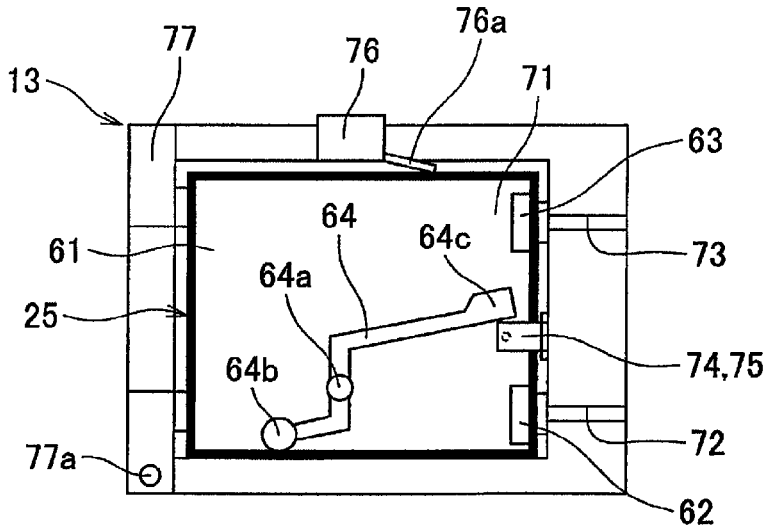
FIG. 8A shows the ink cartridge attached to the second cartridge attaching unit during the operation illustrated in FIG. 5.
Figure 8B:
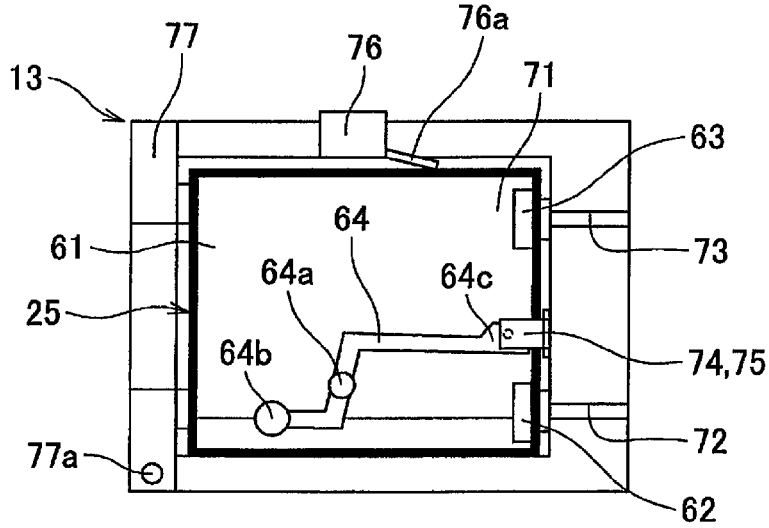
FIG. 8B shows the ink cartridge attached to the second cartridge attaching unit during the operation illustrated in FIG. 5.
Figure 8C:
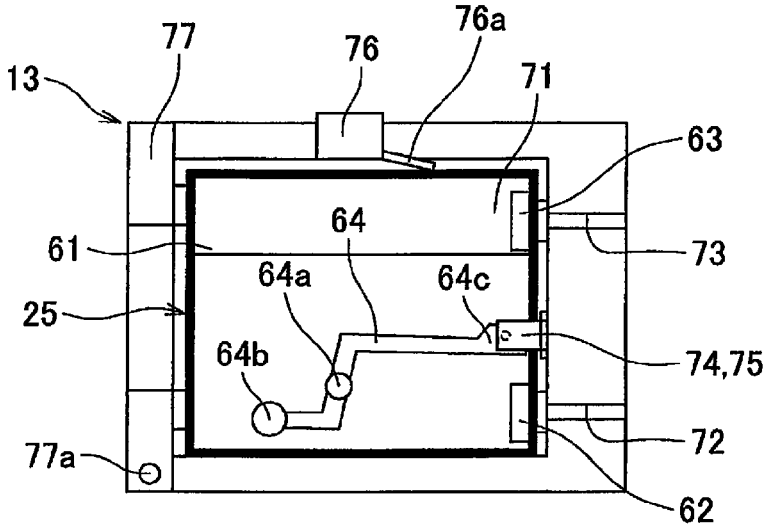
FIG. 8C shows the ink cartridge attached to the second cartridge attaching unit during the operation illustrated in FIG. 5.

Now, described with reference to the flow chart of FIG. 5 and FIG. 2, FIG. 6, FIG. 7, and FIG. 8A to FIG. 8C are the operations of the printer 1 of the present embodiment, which are the operation to suck ink in the inkjet head 3 through the nozzles 31 and convey the ink to the storage tank 10 and the operation to convey ink stored in the storage tank 10 to the ink cartridge 25 attached to the second cartridge attaching unit 13. FIG. 5 is a flowchart of the aforesaid operations of the printer 1. FIG. 6 is equivalent to FIG. 2 and shows a case where ink is sucked from the inkjet head 3 through the nozzles 31 and conveyed to the storage tank 10. FIG. 7 is equivalent to FIG. 2 and shows a case where ink is conveyed from the storage tank 10 to the ink cartridge 25 attached to the second cartridge attaching unit 13. FIGS. 8A to 8C show the second cartridge attaching unit 13 and the ink cartridge 25 attached to the second cartridge attaching unit 13, during the aforesaid operations.

As illustrated in FIG. 2, when power is off, the printer 1 is arranged such that the first valve 11 cuts off the storage tank 10 from the outside air and the second valve 12 cuts off the storage tank 10 from the second cartridge attaching unit 13. This prevents ink from overflowing from the storage tank 10. The operations illustrated in the flowchart of FIG. 5 start when the printer 1 is powered on.

As illustrated in FIG. 5, when the printer 1 is powered on, the first valve 11 stops cutting off the storage tank 10 from the outside air under the control of the valve control unit 121, as illustrated in FIG. 6 (step S101, hereinafter referred to simply as S101, for example). At this point, the second valve 12 is kept to cut off the storage tank 10 from the second cartridge attaching unit 13.

Subsequently, when it is necessary to suck ink from the inkjet head 3 because of reasons such as poor ejection of ink from the nozzles 31, the carriage 2 is moved under the control of the carriage control unit 112 to the position where the inkjet head 3 opposes the suction cap 7, and then the suction cap 7 is moved up so as to cover the nozzles 31, under the control of the cap control unit 109. In this condition, the pump control unit 118 drives the pump 9. Thickened portions of the ink and contaminants in the ink are sucked through the nozzles 31 from the inkjet head 3 as a result, and the sucked matter is conveyed to the storage tank 10. (S102). In short, the mode is switched to the first conveyance mode. The ink conveyed to the storage tank 10 is stored therein.

Until an amount of ink stored in the storage tank 10 becomes equal to or larger than a reference storage amount (S103:NO), the step S102 is repeated. When the storage amount detector 117 detects that an amount of ink stored in the storage tank 10 is equal to or larger than the reference storage amount (S103:YES), the second attachment detector 115 detects whether an ink cartridge 25 is attached to the second cartridge attaching unit 13 (S104). If no ink cartridge 25 is attached (S104:NO), a warning is given for example and the operation is stopped.

On the other hand, when an ink cartridge 25 is attached to the second cartridge attaching unit 13 (S104:YES), the second empty detector 116 detects whether that ink cartridge 25 is in the empty state (S105). If the attached ink cartridge 25 is not in the empty state (S105:NO), a warning is given for example and the operation is stopped.

In the meanwhile, when as illustrated in FIG. 8A the ink cartridge 25 attached to the second cartridge attaching unit 13 is in the empty state (S105:YES), as illustrated in FIG. 7, the first valve 11 cuts off the storage tank 10 from the outside air and the second valve 12 stops cutting off the storage tank 10 from the second cartridge attaching unit 13, under the control of the valve control unit 121 (S106), and then the pump control unit 118 drives the pump 9 (S107). This results in conveying the ink in the storage tank 10 to the ink cartridge 25 attached to the second cartridge attaching unit 13. In short, the mode is switched to the second conveyance mode. An amount of the ink in the aforesaid ink cartridge 25 increases.

Thereafter, until the second empty detector 116 detects that the ink in the ink cartridge 25 attached to the second cartridge attaching unit 13 has increased and the ink cartridge 25 is no longer in the empty state (S108:YES), the conveyance of the ink from the storage tank 10 to the ink cartridge 25 attached to the second cartridge attaching unit 13 is continued. Subsequently, as illustrated in FIG. 8B, when the second empty detector 116 detects that an amount of ink in the ink cartridge 25 attached to the second cartridge attaching unit 13 has increased to the predetermined remaining amount and the ink cartridge 25 is no longer in the empty state (S108:NO), the pump counter 119 starts to count how many times the pump 9 is driven (s109).

Until the number of times the pump 9 is driven, which is counted by the pump counter 119, reaches a predetermined number (S110:YES), the conveyance of the ink from the storage tank 10 to the ink cartridge 25 attached to the second cartridge attaching unit 13 is continued. When the number of times the pump 9 is driven counted by the pump counter 119 reaches the predetermined number (S110:NO), the pump control unit 118 detects, as illustrated in FIG. 8C, that an amount of ink in the ink cartridge 25 attached to the second cartridge attaching unit 13 reaches the limit. When this is the case, the pump control unit 118 causes the pump counter 119 to stop the counting of how many times the pump 9 is driven (S111) and stops the pump 9 (S112) so as to discontinue the conveyance of the ink from the storage tank 10 to the ink cartridge 25 attached to the second cartridge attaching unit 13.

In regard to the conveyance of ink from the storage tank 10 to the ink cartridge 25 attached to the second cartridge attaching unit 13, an amount of ink conveyed by driving the pump 9 once is predetermined. Therefore, an amount of ink conveyed to the ink cartridge attached to the second cartridge attaching unit 13 corresponds to the number of times the pump 9 is driven after the ink cartridge 25 becomes no longer empty. For this reason the ink conveyed from the storage tank 10 does not overflow from the ink cartridge 25 if the number of times the pump 9 is driven is properly set. Thereafter the process returns to the aforesaid S101.

At the point above, an amount of the ink in the storage tank 10 is smaller than the reference storage amount because the ink has been conveyed from the storage tank 10 to the ink cartridge 25 attached to the second cartridge attaching unit 13 as a result of the above-described S106 to S110. The printer 1 can therefore suck the ink from the inkjet head 3 through the nozzles 31 and convey the sucked ink to the storage tank 10, by performing the above-described S101 to S103.

In addition to the above, in case where the ink cartridge 25 attached to the second cartridge attaching unit 13 is replaced with another ink cartridge 25 which is a used cartridge, when an amount of ink in the storage tank 10 becomes equal to or larger than the reference storage amount in the above-described S103 (S103:YES), it is detected in the above-described S104 that the ink cartridge 25 is attached to the second cartridge attaching unit 13 (S104:YES) and it is detected in S105 that the ink cartridge 25 is in the empty state (S105: YES). Thereafter the above-described S106 to S112 are carried out.

In this way, it becomes possible to continue the operation of sucking ink from the inkjet head 3 and conveying the ink to the storage tank 10 when the ink cartridge 25 attached to the second cartridge attaching unit 13 is replaced with another ink cartridge 25 and ink is conveyed from the storage tank 10 to the new ink cartridge 25 attached to the second cartridge attaching unit 13. This elongates the life of the printer 1.

In addition to the above, the printer 1 is arranged so that the power-on detector 120 detects that the printer 1 is powered off. When power-off is detected, the valve control unit 121 causes the first valve 11 to cut off the storage tank 10 from the outside air and causes the second valve to cut off the storage tank 10 from the second cartridge attaching unit 13. This prevents ink from overflowing from the storage tank 10 when the printer 1 is powered off. As a matter of course, if the printer 1 is powered off in the middle of the operation of FIG. 5, the operation of FIG. 5 is discontinued and the aforesaid blocking operation is carried out by the first valve 11 and the second valve 12.

According to the above-described embodiment, the pump 9 is driven while the first valve 11 does not cut off the storage tank 10 from the outside air whereas the second valve 12 cuts off the storage tank 10 from the second cartridge attaching unit 13, more specifically from the used ink cartridge 25 attached to the second cartridge attaching unit 13. With this, via the suction cap 7, ink in the inkjet head 3 is sucked through the nozzles 31 and conveyed to the storage tank 10 (first conveyance mode).

Furthermore, the pump 9 is driven while the first valve 11 cuts off the storage tank 10 from the outside air whereas the second valve 12 does not cut off the storage tank 10 from the second cartridge attaching unit 13, more specifically from the used ink cartridge 25 attached to the second cartridge attaching unit 13. With this, ink stored in the storage tank 10 is conveyed to the ink cartridge 25 attached to the second cartridge attaching unit 13 (second conveyance mode). The amount of the ink in the storage tank 10 is reduced as a result, and hence a space for storing ink is created in the storage tank 10.

In this way, it becomes possible to continue the operation of sucking ink from the inkjet head 3 and conveying the ink to the storage tank 10 when the used ink cartridge 25 attached to the second cartridge attaching unit 13 is replaced with another ink cartridge 25 and ink is conveyed from the storage tank 10 to the new ink cartridge 25 attached to the second cartridge attaching unit 13. This elongates the life of the printer 1.

Furthermore, the pump 9 functions not only as a power source for sucking ink from the inkjet head 3 through the nozzles 31 and conveying the same to the storage tank 10 but also a power source for conveying ink stored in the storage tank 10 to the ink cartridge 25 attached to the second cartridge attaching unit 13, because the connection and cutoff between the storage tank 10 and the outside air are switched by the first valve 11 and the connection and cutoff between the storage tank 10 and the second cartridge attaching unit 13, more specifically between the storage tank 10 and the ink cartridge 25 attached to the second cartridge attaching unit 13 are switched by the second valve 12. Therefore it is unnecessary to provide different power sources and hence the structure of the printer 1 is kept simple.

Furthermore, to/from this second cartridge attaching unit 13, a used ink cartridge 25 which is in the empty state is attachable/detachable. This makes it possible to effectively recycle used ink cartridges 25.

Furthermore, the suction cap 7, the switching unit 8, the pump 9, the storage tank 10, and the second cartridge attaching unit 13 are disposed to the right of the sheet conveyance path 41 in FIG. 1 in the scanning directions. Therefore these components are disposed to be close to one another, and hence the conveyance of ink on the ink discharge path is easily done, including the conveyance of ink from the storage tank 10 to the ink cartridge 25 attached to the second cartridge attaching unit 13.

In addition to the above, when the printer 1 is powered off, the first valve 11 cuts off the storage tank 10 from the outside air and the second valve 12 cuts off the storage tank 10 from the second cartridge attaching unit 13, more specifically from the ink cartridge 25 attached to the second cartridge attaching unit 13. This makes it possible to prevent ink from overflowing from the storage tank 10, when the printer 1 is powered off.

The following discusses a variation in which various modifications are made to the embodiment above. It is noted that the same structural elements as those explained in the embodiment above will be assigned with the same reference numerals and the detailed explanations thereof will be suitably omitted.

Figure 9:
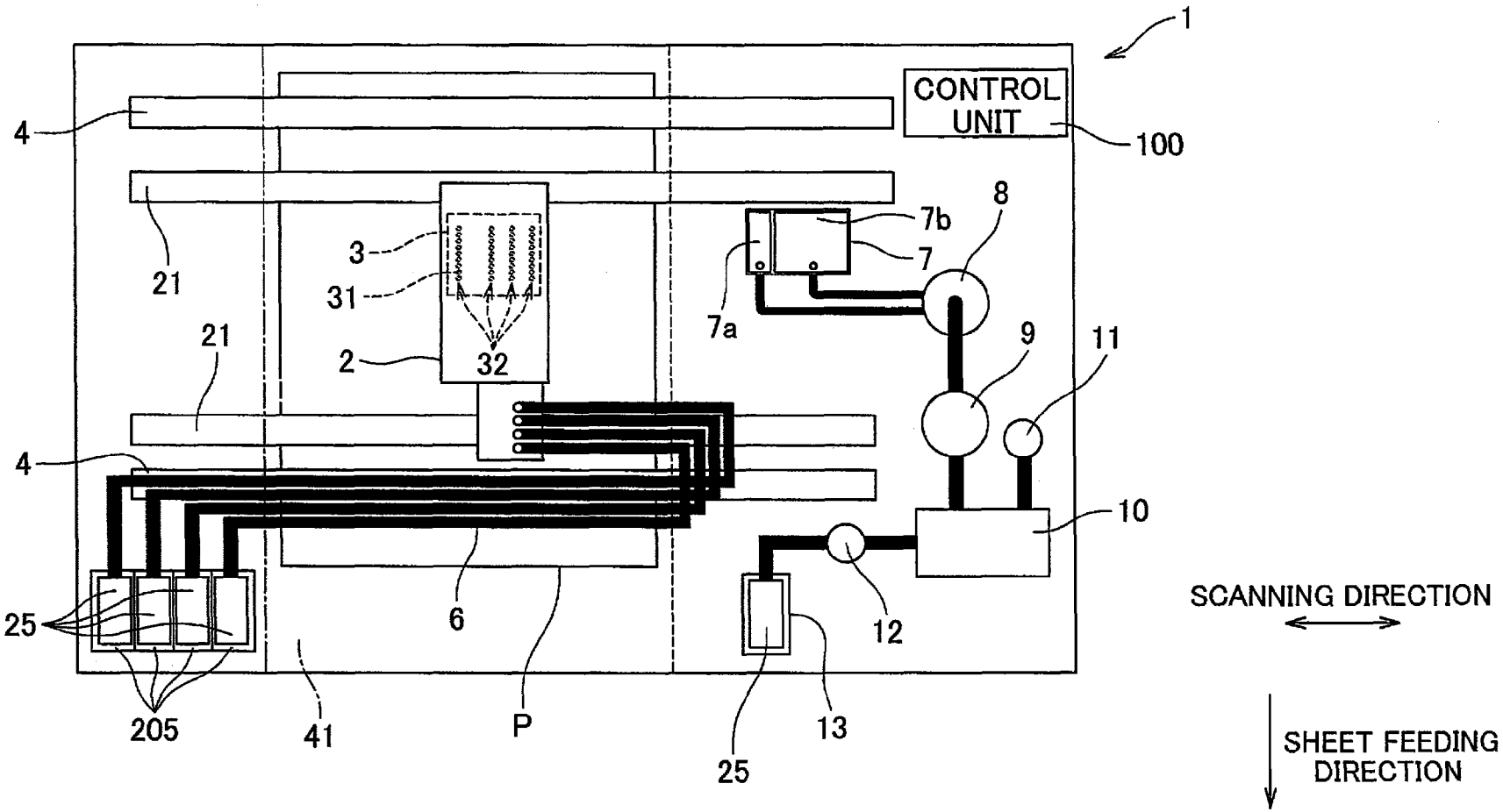
FIG. 9 relates to a variant 1 and is equivalent to FIG. 1.

In the variation, as illustrated in FIG. 9, a first cartridge attaching unit 205 is disposed to the left of the sheet conveyance path 41 so that, in the scanning directions, the first cartridge attaching unit 205 opposes the second cartridge attaching unit 13 over the sheet conveyance path 41, more specifically an ink cartridge 25 which is a third tank attached to the first cartridge attaching unit 205 opposes an ink cartridge 25 which is a second tank attached to the second cartridge attaching unit 13, over the sheet conveyance path 41 (variation 1).

In the embodiment above, both the first cartridge attaching unit 5 and the second cartridge attaching unit 13 are disposed to the right of the sheet conveyance path 41, and the suction cap 7, the switching unit 8, the pump 9, and the storage tank 10 are also disposed to the right of the sheet conveyance path 41. The printer 1 is therefore required to have a space where the aforesaid components are disposed to the right of the sheet conveyance path 41. This may require the printer 1 to be large in size.

In this regard, the embodiment above is arranged so that the guides 21 extend beyond the boundaries of a sheet conveyance path 41 in both scanning directions, in such a way as to allow the carriage 2 to reciprocate in the scanning directions beyond the boundaries of the sheet conveyance path 41. The printer 1 therefore has spaces to the right and left of the sheet conveyance path 41.

In the variation 1, the first cartridge attaching unit 205 is disposed in the space to the left of the sheet conveyance path 41. It is therefore possible to downsize the printer 1 by, for example, as illustrated in FIG. 9, disposing the second cartridge attaching unit 13 in the space where the first cartridge attaching unit 5 is originally disposed and disposing the components such as the switching unit 8, the pump 9, and the storage tank 10 in the space where the second cartridge attaching unit 13 is originally disposed.

It is noted that a similar effect is achieved when the second cartridge attaching unit is disposed to the left of the sheet conveyance path 41, instead of disposing the first cartridge attaching unit in the space to the left of the sheet conveyance path 41. In this case, however, since the path that connects the storage tank 10 with the second cartridge attaching unit must be disposed to cross over the sheet conveyance path 41, it is necessary to contemplate the arrangement of that path. Also in the case above, since the path connecting the storage tank 10 with the second cartridge attaching unit is long, it is necessary to set the pressure of the pump 9 to be high enough to convey ink from the storage tank 10 to the ink cartridge 25 attached to the second cartridge attaching unit.

In the embodiment above, the second cartridge attaching unit 13 is connected to the downstream end of the ink discharge path and a used ink cartridge 25 is attached to the second cartridge attaching unit 13. The invention, however, is not limited to this. For example, the second cartridge attaching unit 13 may be arranged to be connectable with not a used ink cartridge 25 but a dedicated cartridge. Alternatively, the present invention may be configured so that the second cartridge attaching unit 13 is not provided and a tank (second tank) which is detachable to the printer 1 is detachably attached directly to the downstream end of the ink discharge path.

In the embodiment above, the first valve 11 cuts off the storage tank 10 from the outside air and the second valve 12 cuts off the storage tank 10 from the second cartridge attaching unit 13 when the printer 1 is powered off. Alternatively, when the printer 1 is powered off, the first valve 11 and the second valve 12 may not be operated and is kept in the state before the power-off.

In the embodiment above, ink is conveyed from the storage tank 10 to the ink cartridge 25 attached to the second cartridge attaching unit 13 when an amount of ink in the storage tank 10 becomes equal to or larger than the reference storage amount. Alternatively, for example, ink may be periodically conveyed from the storage tank 10 to the ink cartridge 25 attached to the second cartridge attaching unit 13 irrespective of an amount of ink stored in the storage tank 10.

In the embodiment above, an amount of ink conveyed from the storage tank 10 to the ink cartridge 25 attached to the second cartridge attaching unit 13 is adjusted in such a way that, after the conveyance of ink from the storage tank 10 to the ink cartridge 25 attached to the second cartridge attaching unit 13 is started and the ink cartridge 25 becomes no longer in the empty state, the pump 9 is further driven for a predetermined number of times, so that ink is conveyed from the storage tank 10 to the ink cartridge 25. The present invention, however, is not limited to this. For example, an amount of ink conveyed from the storage tank 10 to the ink cartridge 25 attached to the second cartridge attaching unit 13 may be adjusted in such a way that a sensor or the like which detects an amount of ink in the storage tank 10 is provided in place of the liquid level sensor 14 which detects only whether an amount of ink in the storage tank 10 is not smaller than the reference storage amount, and an amount of ink conveyed from the storage tank 10 to the ink cartridge 25 is adjusted based on the amount of the ink in the storage tank 10 detected by the sensor.

In the explanation above, the present invention is used in a printer having an inkjet head which ejects ink onto a record sheet through nozzles. Alternatively, the present invention may be used in a liquid ejector which ejects a liquid other than ink.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A liquid ejector comprising:

a liquid ejection head which ejects a liquid through a nozzle;

a discharge path used for discharging the liquid from the liquid ejection head;

a cap which is connected to an upstream end of the discharge path and covers the nozzle;

a pump which is provided in the middle of the discharge path, the pump sucking the liquid from the liquid ejection head through the cap and the nozzle and conveying the liquid from the upstream end to a downstream end of the discharge path;

a first tank which is provided downstream of the pump on the discharge path, communicates with the outside air, and temporarily stores the liquid in the discharge path;

a second tank which is detachably attached to the liquid ejector and is connected to the downstream end of the discharge path when the second tank is attached to the liquid ejector;

a first valve which switches a state of the first tank between open to the outside air and cut off from the outside air;

a second valve which switches a state of the first tank between connection to the second tank and cut off from the second tank; and a control unit which controls the pump, the first valve, and the second valve so as to switch between:

a first conveyance mode in which the pump is driven while the first valve does not cut off the first tank from the outside air whereas the second valve cuts off the first tank from the second tank, so that the liquid in the liquid ejection head is sucked through the cap and the nozzle and conveyed to the first tank, and a second conveyance mode in which the pump is driven while the first valve cuts off the first tank from the outside air whereas the second valve does not cut off the first tank from the second tank, so that the liquid stored in the first tank is conveyed to the second tank.

2. The liquid ejector according to claim 1, further comprising a third tank which is filled with a liquid supplied to the liquid ejection head and is detachable to the liquid ejector, wherein the second tank is a used third tank.

3. The liquid ejector according to claim 2, further comprising a liquid target medium carrier unit which carries a liquid target medium on which the liquid ejected from the liquid ejection head lands, in a predetermined single direction along a predetermined conveyance path, wherein:

the liquid ejection head is structured to be able to cross over the conveyance path, in a direction perpendicular to the predetermined single direction, and the second tank and the third tank are disposed across from one another over the conveyance path, in the direction perpendicular to the predetermined single direction.

4. The liquid ejector according to claim 1, further comprising a liquid target medium carrier unit which carries a liquid target medium on which the liquid ejected from the liquid ejection head lands, in a predetermined single direction along a predetermined conveyance path, wherein:

the liquid ejection head is structured to be able to cross over the conveyance path, in directions perpendicular to the predetermined single direction, and the first tank and the second tank are disposed on a single side with respect to the conveyance path, in the directions perpendicular to the predetermined single direction.

5. A liquid ejector comprising:

a liquid ejection head which ejects a liquid through a nozzle;

a discharge path used for discharging the liquid from the liquid ejection head;

a cap which is connected to an upstream end of the discharge path and covers the nozzle;

a pump which is provided in the middle of the discharge path, the pump sucking the liquid from the liquid ejection head through the cap and the nozzle and conveying the liquid from the upstream end to a downstream end of the discharge path;

a first tank which is provided downstream of the pump on the discharge path, communicates with the outside air, and temporarily stores the liquid in the discharge path;

a second tank which is detachably attached to the liquid ejector and is connected to the downstream end of the discharge path when the second tank is attached to the liquid ejector;

a first valve which switches a state of the first tank between open to the outside air and cut off from the outside air;

a second valve which switches a state of the first tank between connection to the second tank and cut off from the second tank; and a control unit which controls the pump, the first valve, and the second valve, wherein, when the liquid ejector is powered off, the control unit controls the first valve and the second valve so that the first tank is cut off from the outside air and the first tank is cut off from the second tank.

6. The liquid ejector according to claim 5, wherein the control unit controls the pump, the first valve, and the second valve so as to switch between:

a first conveyance mode in which the pump is driven while the first valve does not cut off the first tank from the outside air whereas the second valve cuts off the first tank from the second tank, so that the liquid in the liquid ejection head is sucked through the cap and the nozzle and conveyed to the first tank, and a second conveyance mode in which the pump is driven while the first valve cuts off the first tank from the outside air whereas the second valve does not cut off the first tank from the second tank, so that the liquid stored in the first tank is conveyed to the second tank.

7. The liquid ejector according to claim 5, further comprising a third tank which is filled with a liquid supplied to the liquid ejection head and is detachable to the liquid ejector, wherein the second tank is a used third tank.

8. The liquid ejector according to claim 7, further comprising a liquid target medium carrier unit which carries a liquid target medium on which the liquid ejected from the liquid ejection head lands, in a predetermined single direction along a predetermined conveyance path, wherein:

the liquid ejection head is structured to be able to cross over the conveyance path, in a direction perpendicular to the predetermined single direction, and the second tank and the third tank are disposed across from one another over the conveyance path, in the direction perpendicular to the predetermined single direction.

9. The liquid ejector according to claim 5, further comprising a liquid target medium carrier unit which carries a liquid target medium on which the liquid ejected from the liquid ejection head lands, in a predetermined single direction along a predetermined conveyance path, wherein:

the liquid ejection head is structured to be able to cross over the conveyance path, in directions perpendicular to the predetermined single direction, and the first tank and the second tank are disposed on a single side with respect to the conveyance path, in the directions perpendicular to the predetermined single direction.

* * * * *